United States Patent [19]

Grandfield et al.

[11] Patent Number: 4,757,287

[45] Date of Patent: Jul. 12, 1988

[54] VOLTAGE TUNABLE HALF WAVELENGTH MICROSTRIP FILTER

[75] Inventors: John Grandfield, Assonet; William Shillue, Norwood, both of Mass.

[73] Assignee: GTE Service Corporation, Waltham, Mass.

[21] Appl. No.: 110,755

[22] Filed: Oct. 20, 1987

[51] Int. Cl.[4] ..... H01P 1/203; H01P 7/08

[52] U.S. Cl. ..... 333/205; 333/202; 333/223; 333/235

[58] Field of Search ..... 333/202, 203, 204, 205, 333/219, 222, 235, 223, 206, 207, 245, 246; 331/96, 101, 107 DF, 107 SL, 117 D; 334/41, 42, 45, 15

[56] References Cited

U.S. PATENT DOCUMENTS 4,578,656 3/1986 Lacour et al. ..... 333/205 X

*Primary Examiner*—Marvin L. Nussbaum

*Attorney, Agent, or Firm*—J. Stephen Yeo

[57] ABSTRACT

A voltage tunable filter has several parallel coupled half wavelength lines. Each open end of a line is coupled to ground through a corresponding varactor. Voltage may be distributed to the varactors through a thin wire attached a quarter wavelength from each varactor.

4 Claims, 3 Drawing Sheets

VOLTAGE TUNABLE HALF WAVELENGTH MICROSTRIP FILTER

RELATED COPENDING APPLICATIONS

Ser. No. 110 396 filed Oct. 20, 1987 "Direct Frequency Synthesizer " divulges a circuit which includes a tunable filter, such as the subject of the present invention.

BACKGROUND OF THE INVENTION

This invention pertains to microwave components and more particularly is concerned with voltage tunable filters.

The need arises in many microwave applications for tunable filters. In a direct frequency synthesizer, for example, a mix-and-divide approach is used to synthesize discrete frequencies. The mixing process generates many unwanted high level spurious signals which must be filtered. Typically, four or more local oscillators are used, yielding several different frequency ranges to be filtered.

Prior to the tunable half wavelength microstrip bandpass filter, disclosed herein, approach, it was necessary to utilize either a single fixed filter or a bank of four or more fixed filters in which the correct filter could be switched in line with the mixer output. These filters would most likely be the coupled line type for frequency ranges above 1 GHz. The filter bank method has the disadvantage of requiring a lot of space, the amount of which is directly proportional to the number of filters required. Quarter wavelength coupled line filters with varactors are known. These filters are voltage tunable but do not have the bandpass characteristics needed for applications such as direct frequency synthesizers. Further, one end of each quarter wavelength line has to be at RF ground, which is difficult to define at high frequencies.

The lack of a single filter suitable for filtering unwanted mixer products has been one of the difficulties in the mix-and-divide, or direct synthesizer approach.

An object of the invention is to provide a bandpass filter voltage tunable over a frequency range. Another object of the invention is to provide a simple bias circuit to control the tuning voltage.

SUMMARY OF THE INVENTION

Briefly, according to one aspect of the invention, there is provided a voltage tunable microstrip filter.

A ground plane is in contact with a first side of a dielectric substrate. Conductive strips in contact with a second side of the substrate. At least some of the strips are parallel lines approximately one-half wavelength long at a design frequency. Each of said parallel lines has at least one open circuit end. A varactor is coupled between each open circuit end and the ground plane. Bias voltage is distributed to the varactors.

DETAILED DESCRIPTION OF THE INVENTION

Figure 1:
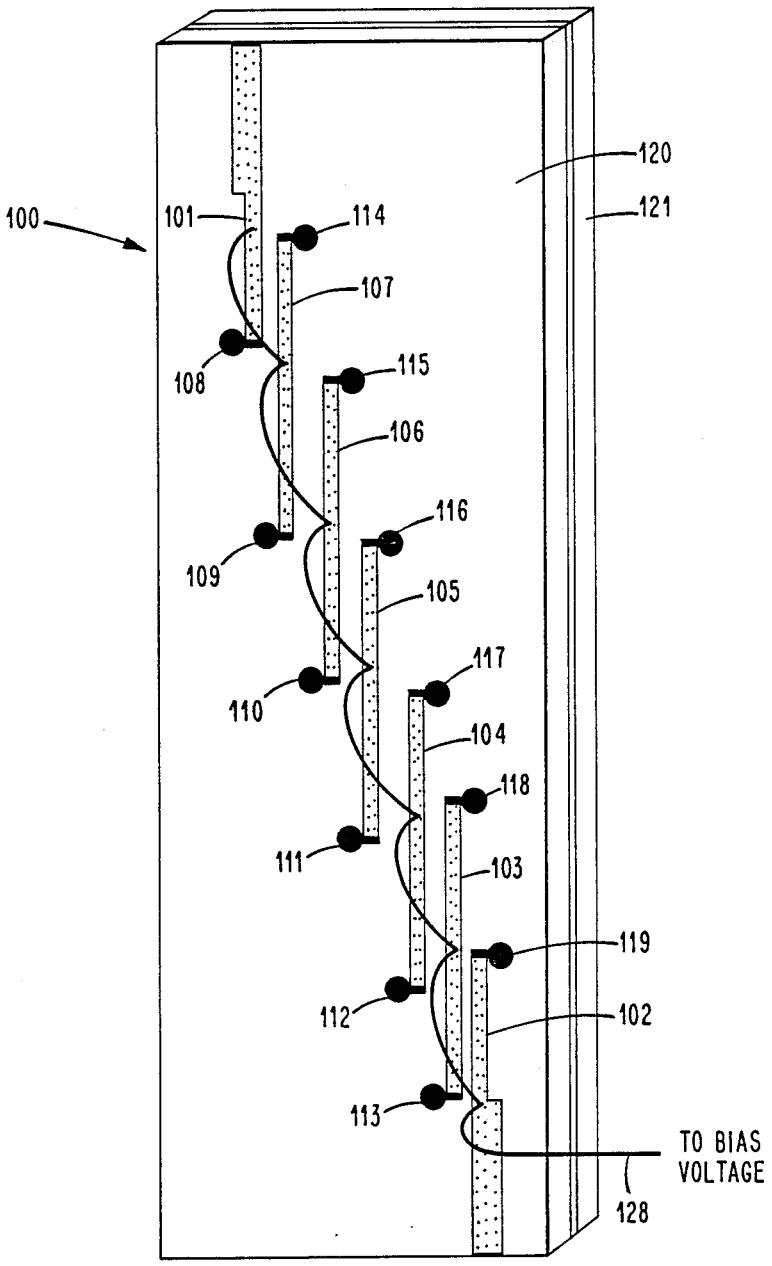
FIG. 1 represents a tunable microstrip filter embodying the invention.

A tunable microstrip filter 100 embodying the invention is seen in FIG. 1.

As is well known in the art, microstrip is a RF transmission media in which a conductive strip is spaced from a ground plane. The conductive strip is usually supported by a dielectric substrate such as Rogers RT (TM) duriod. The dielectric substrate is mounted upon a metal substrate, e.g. aluminum, which provide rigidity and functions as a ground plane; The conductive strip together with the ground plane form a transmission line, the characteristic impedance of which is a function of the dielective constant and thickness of the dielective substrate, and the width of the conductive strip. If the other parameters are held constant, the characteristic impedance increases non-linearly as the width decreases.

The side of the dielectric substrate in contact with the ground plane is herein called the first side; the side of the dielectic substrate in contact with the conductive strip is called the second side.

The particular filter illustrated is a five pole coupled line bandpass filter having seven parallel lines 101–107, offset and spaced apart. The lines are on a dielectric substrate 120 mounted to a ground plane 121.

Two of the filter lines 101, and 102 are approximately one-quarter wavelength long and have one open circuit end each, while the remaining five lines 103–107 are approximately one-half wavelength long and have two open circuit ends each. The lengths are calculated for a design frequency.

Resonance occurs at the frequency at which each double open ended line is exactly one half wavelength long. The open circuit ends of the lines are high impedance, and the centers of the lines are low impedance. As the high impedance sections are aligned across from the low impedance centers, energy is effectively coupled across the gaps at resonance. At frequencies lower or higher than the passband, the resonance condition does not exist and energy is reflected at the filter input, rather than transmitted to the output. The widths and spacings of the lines determine the bandwidth and the nature of the inband response, which is, preferably, Chebyshev, or equiripple, to minimize the variation in inband loss.

As a feature of the invention, each open circuit end of a filter line is coupled to the ground plane 121 through a corresponding varactor 108–119.

A varactor is a two electrode pn diode which functions as a voltage controlled capacitor. A positive voltage bias applied to the cathode decreases the capacitance.

Figure 2:
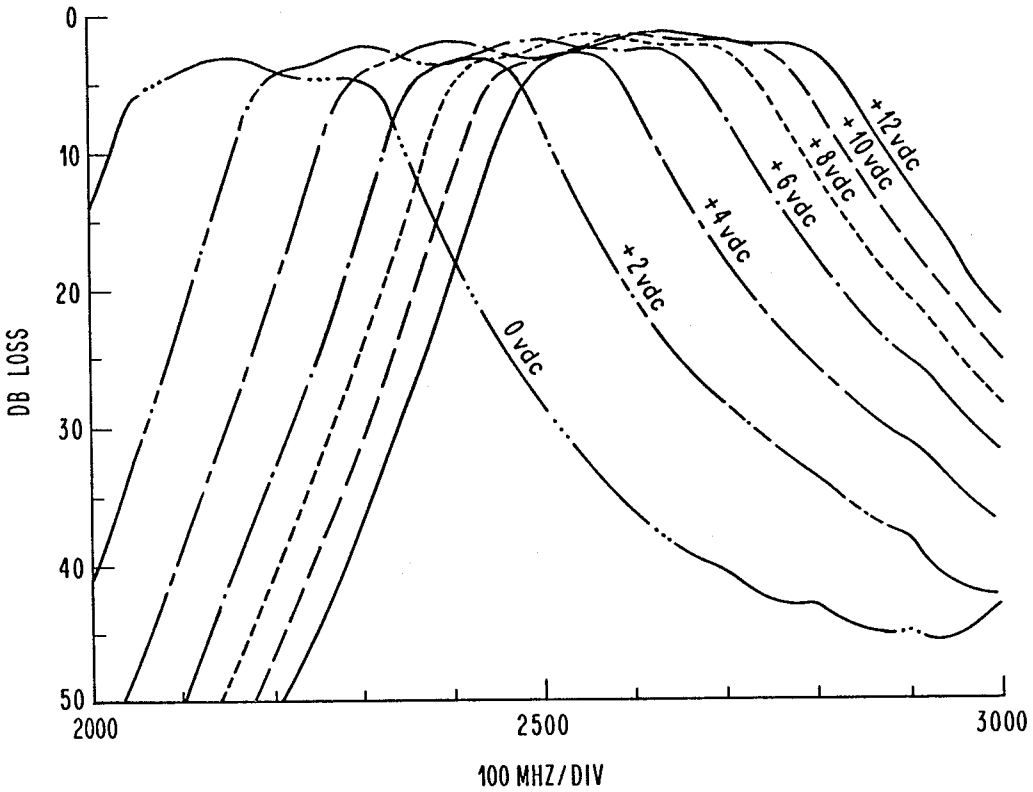
FIG. 2 is a set of curves showing how the passband of the filter changes with voltage.

The varactors provide means of controlling the response of the filter. A charge in the bias voltage will yield a corresponding charge in the center frequency of the filter as seen in FIG. 2. The parallel lines of the filter can be modeled as a distributed LC filter. The varactors add a lumped capacitance to the open circuit ends of each line, which makes the effective electrical length of the line longer, and upsets the optimized Chebyshev response of the filter. The effect of a longer line is to make the half-wave frequency lower, and thus the passband range is shifted down. As the bias on the varactors is varied to increase their capacitance, the passband moves lower.

Because the filter can be tuned with very small capacitances, and the presence of any large capacitance upsets the filter performance, it is necessary to choose varaction diodes with the smallest available package capacitance, and a capacitance ratio that would allow the filter to be tuned over the desired band, e.g. 2500–3500 MHz in the example. The package must also be chosen to fit easily into a microwave assembly. A suitable varactor is type GC51105-82. For the five pole filter shown twelve varactors are used.

Figure 3:
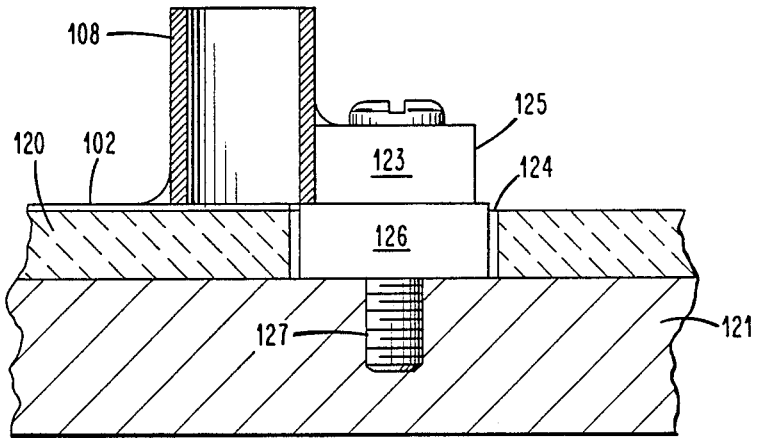
FIG. 3 illustrates a ground plane extender used in the filter of FIG. 1.

A common method of connecting components to an aluminum ground plane uses silver epoxy, which may impregnate the dielective material and compromise the performance of the circuit. To avoid this potential problem a ground plane extender 122 may be provided as seen in FIG. 3. There is fringing capacitance from the end of a line to the extender. The ground plane extender also assures that each varactor has a low inductive path to ground. The varactor and fringing capacitance are in parallel.

The ground plane extender 122 includes a metal (e.g. brass) pedestal 123 which extends through a hole 124 in the dielective substrate 120 in proximity to the open circuit end of a filter line, e.g. 102. The pedestal 123 may be circular with two segments 126, and 127, the upper segment 126 having a slightly smaller diameter than the lower segment 127. The pedestal 123 is secured by a through screw 127 which is threaded in a tapped hole in the metal substrate 121. One electrode of a varactor, e.g. 108 is soldered to the pedestal with the other electrode soldered to the open end of a filter strip, e.g. 102.

The polarity of each varactor is arranged the same way. For example, the anode may be soldered to the ground plane extender and the cathode soldered to the filter line.

As seen in FIG. 1, bias voltage may be applied to the varactors through a thin wire 128 soldered or otherwise connected to the centers of the half wavelength filter sections, and at the transition of each quarter wave section. The wire is thus a quarter wavelength from each varactor. A single bias voltage source biases all the varactors of the filter.

Figure 4:
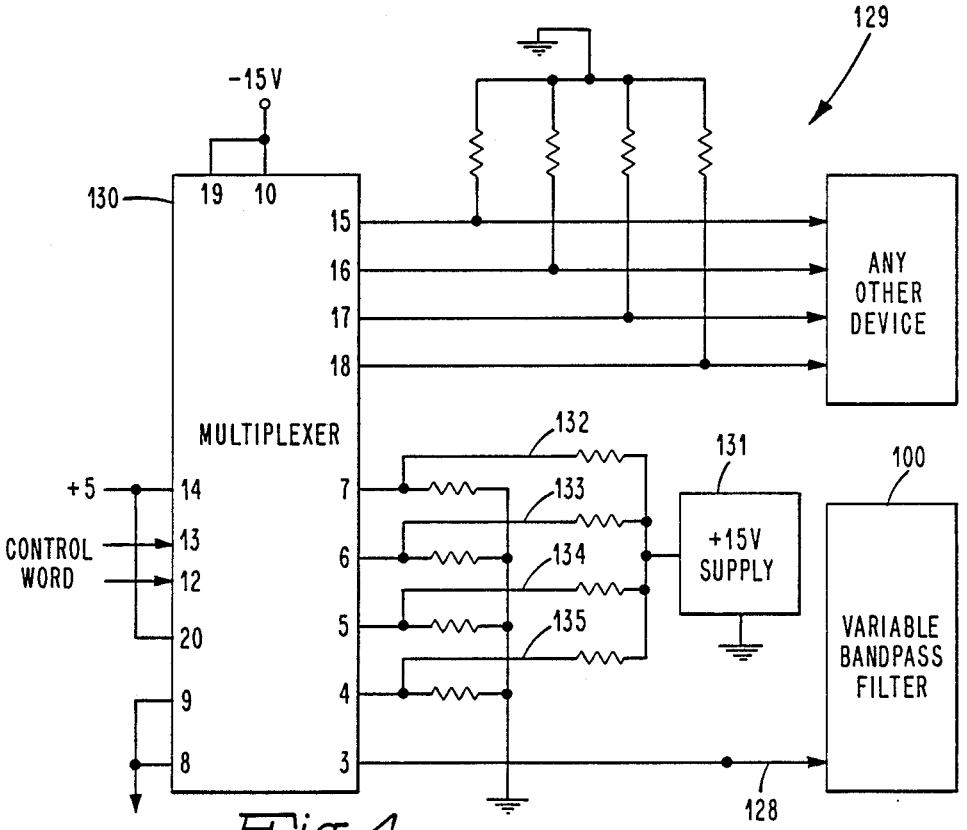
FIG. 4 is a schematic representation of a digitally controlled circuit for the filter of FIG. 1.

The bias voltage level may be digitally controlled by the control circuit such as seen in FIG. 4. A high speed multiplexer converts a two bit digital control signal into one of four bias voltages for the filter. A Harris HI 518-T multiplexer may be used. A d.c. voltage supply 131 is coupled through four voltage divider circuits 132–135 to the multiplexer. The multiplexer couples one of the four voltage divider circuits to the bias wire 128 of the tunable filter 100 in response to the two bit control.

The best mode and preferred embodiment of the invention has been described. Other embodiments will now be apparent to those skilled in the art. The scope of invention is therefore to be determined by the following claims.

We claim:

1. A tunable microstrip filter comprising:

a dielectric substrate having a first side and a second side;

a ground plane in contact with said first side;

a plurality of conductive strips in contact with said second side, at least some of which are parallel lines approximately one-half wavelength long at a design frequency, each of said parallel lines having at least one open circuit end;

a plurality of varactors, each varactor coupled between a separate open circuit end and the ground plane; and means for distributing bias voltage to said varactors.

2. The filter of claim 1 wherein said means for distributing bias voltage includes a wire attached to each line a quarter wavelength from a varactor.

3. The filter of claim 1 which further includes a ground plane extender, corresponding to each varactor, comprised of metal pedestal extending through a hole in said dielective substrate in proximity to an open circuit end and secured to said ground plane by a screw.

4. The filter of claim 1 which further includes means for shifting the band of said filter in response to a digital word, comprised of a voltage source; a plurality of voltage dividers coupled to said voltage sources; and a multiplexer interposed between said voltage dividers and said means for distributing bias current, said multiplexer responsive to digital words for selectively coupling one of said voltage dividers to said means for distributing bias current.

* * * * *